US010906299B2

(12) United States Patent
Nakano

(10) Patent No.: US 10,906,299 B2
(45) Date of Patent: Feb. 2, 2021

(54) PRINT HEAD AND ACTIVATION SYSTEM

(71) Applicant: SEIKO EPSON CORPORATION, Tokyo (JP)

(72) Inventor: Shuichi Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/752,751

(22) Filed: Jan. 27, 2020

(65) Prior Publication Data

US 2020/0238690 A1 Jul. 30, 2020

(30) Foreign Application Priority Data

Jan. 28, 2019 (JP) ..... 2019-012393

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC .. B41J 2/0458; B41J 2/04596; B41J 2/04588; B41J 2/04581; B41J 2/04551; B41J 2/04593; B41J 2/04515; B41J 2/0452; B41J 2/04525; B41J 2/04526; B41J 2/04555; B41J 2/04558; B41J 2/04536; B41J 2/0456; B41J 2/04561; B41J 2/04563; B41J 2/04565; B41J 2/04566; B41J 2/04568; B41J 2/0457
See application file for complete search history.

(56) References Cited

U.S. PATENT DOCUMENTS

| | | | |
|---|---|---|---|
| 2002/0145640 | A1 | 10/2002 | Anderson et al. |
| 2004/0239711 | A1 | 12/2004 | Koehler et al. |
| 2016/0062292 | A1 | 3/2016 | Umenaga et al. |

FOREIGN PATENT DOCUMENTS

| | | | |
|---|---|---|---|
| EP | 1029674 | A2 | 8/2000 |
| JP | 2016-052045 | A | 4/2016 |
| JP | 2017-098853 | A | 6/2017 |

*Primary Examiner* — Kristal Feggins
(74) *Attorney, Agent, or Firm* — Global IP Counselors, LLP

(57) ABSTRACT

There is provided a print head discharging a liquid from a nozzle, including: a memory circuit that stores individual information of the print head and individual activation information based on the individual information; a communication control circuit that controls communication between the print head and an outside; a discharge control circuit that controls discharge of the liquid; and a limiting circuit that limits liquid discharge control by the discharge control circuit, in which when a signal according to the individual activation information is input from the outside, the limiting circuit changes a limitation of liquid discharge control by the discharge control circuit.

6 Claims, 15 Drawing Sheets

| EN | | H | | | | L |
|---|---|---|---|---|---|---|
| [SIH, SIL] | | [1, 1] | [1, 0] | [0, 1] | [0, 0] | [–, –] |
| S | T1 | H | H | L | L | L |
| | T2 | H | L | H | L | L |
| | T3 | L | L | L | H | L |

| EN | | H | | | | L |
|---|---|---|---|---|---|---|
| [SIH, SIL] | | [1, 1] | [1, 0] | [0, 1] | [0, 0] | [–, –] |
| S | T1 | H | H | L | L | L |
| | T2 | H | L | H | L | L |
| | T3 | L | L | L | H | L |

FIG. 11

| PERMANENT DISCHARGE CONTROL INFORMATION PDI | | H | | L | |
|---|---|---|---|---|---|
| DISCHARGE CONTROL INFORMATION DI | | H | L | H | L |
| DISCHARGE LIMITING SIGNAL EN | ACTIVATION MATCH INFORMATION CA IS INFORMATION CORRESPONDING TO ACTIVATION INFORMATION CI. | H | L | H | L |
| | ACTIVATION MATCH INFORMATION CA IS NOT INFORMATION CORRESPONDING TO ACTIVATION INFORMATION CI. | H | L | L | L |

PRINT HEAD AND ACTIVATION SYSTEM

The present application is based on, and claims priority from JP Application Serial Number 2019-012393, filed Jan. 28, 2019, the disclosure of which is hereby incorporated by reference herein in its entirety.

BACKGROUND

1. Technical Field

The present disclosure relates to a print head and an activation system.

2. Related Art

In the related art, printing apparatuses that perform activation with respect to each of various mechanisms constituting a printing apparatus such as a print head, a scanner, and a facsimile are known.

For example, JP-A-2017-098853 discloses a printing apparatus in which a multifunction printer (MFP), which is a type of printing apparatus, transmits identification information of an application selected for an additional function to an external computer, then the computer transmits software based on the received identification information to the MFP, and the MFP executes the received software, thereby activation processing of the additional function is executed.

Further, JP-A-2016-052045 discloses a printing apparatus that enables activation of a function to be added even when the printing apparatus is not connected to an external network.

However, JP-A-2017-098853 and JP-A-2016-052045 do not disclose activation processing when a part of the configuration of the printing apparatus is replaced. In particular, when a print head that constitutes the printing apparatus is replaced, there is a risk that printing quality may deteriorate due to variations in the discharge characteristics of the print head. Furthermore, when a print head with different specifications is attached before and after replacement, the printing apparatus may break down. As described above, in the activation function included the printing apparatuses that are described in JP-A-2017-098853 and JP-A-2016-052045, the activation function of the print head is not sufficient, and there is room for improvement.

SUMMARY

According to an aspect of the present disclosure, there is provided a print head discharging a liquid from a nozzle, including: a memory circuit that stores individual information of the print head and individual activation information based on the individual information; a communication control circuit that controls communication between the print head and an outside; a discharge control circuit that controls discharge of the liquid; and a limiting circuit that limits liquid discharge control by the discharge control circuit, in which when a signal according to the individual activation information is input from the outside, the limiting circuit changes a limitation of liquid discharge control by the discharge control circuit.

In the print head, the memory circuit may store discharge control information that is information for limiting liquid discharge control by the discharge control circuit, and the discharge control information may be rewritten when a signal according to the individual activation information is input from the outside.

In the print head, the individual information may include a production number of the print head.

In the print head, the individual information may include a serial number of the print head.

In the print head, the print head may further include a drive element that is driven to cause the nozzle to discharge the liquid, in which the individual information may include drive characteristics of the drive element.

In the print head, the drive characteristics may include a maximum voltage value of a drive signal for driving the drive element.

According to another aspect of the present disclosure, there is provided an activation system including: a print head discharging a liquid from a nozzle; and an individual activation information generation circuit, in which the print head has a memory circuit that stores individual information of the print head and individual activation information based on the individual information, a communication control circuit that controls communication between the print head and an outside, a discharge control circuit that controls discharge of the liquid, and a limiting circuit that limits liquid discharge control by the discharge control circuit, the individual activation information generation circuit is configured to communicate with the print head, and generates the individual activation information based on the individual information, and when a signal according to the individual activation information is input from the outside, the limiting circuit changes a limitation of liquid discharge control by the discharge control circuit.

BRIEF DESCRIPTION OF THE DRAWINGS

FIG. 11 is a diagram showing an example of a selection control signal generated by a determination unit.

DESCRIPTION OF EXEMPLARY EMBODIMENTS

Hereinafter, preferred embodiments of the present disclosure will be described with reference to the drawings. The drawings used are for convenience of explanation. Note that the embodiments described below do not unduly limit the contents of the present disclosure described in the claims. In addition, not all of the configurations described below are necessarily essential configuration requirements of the present disclosure.

1. Configuration of Liquid Discharging Apparatus

A printing apparatus 1 as an example of a liquid discharging apparatus according to the present embodiment forms dots on a printing medium such as paper by discharging ink according to image data supplied from an external host computer. Accordingly, the printing apparatus 1 prints an image including characters, figures, or the like according to the image data on a printing medium.

Figure 1:
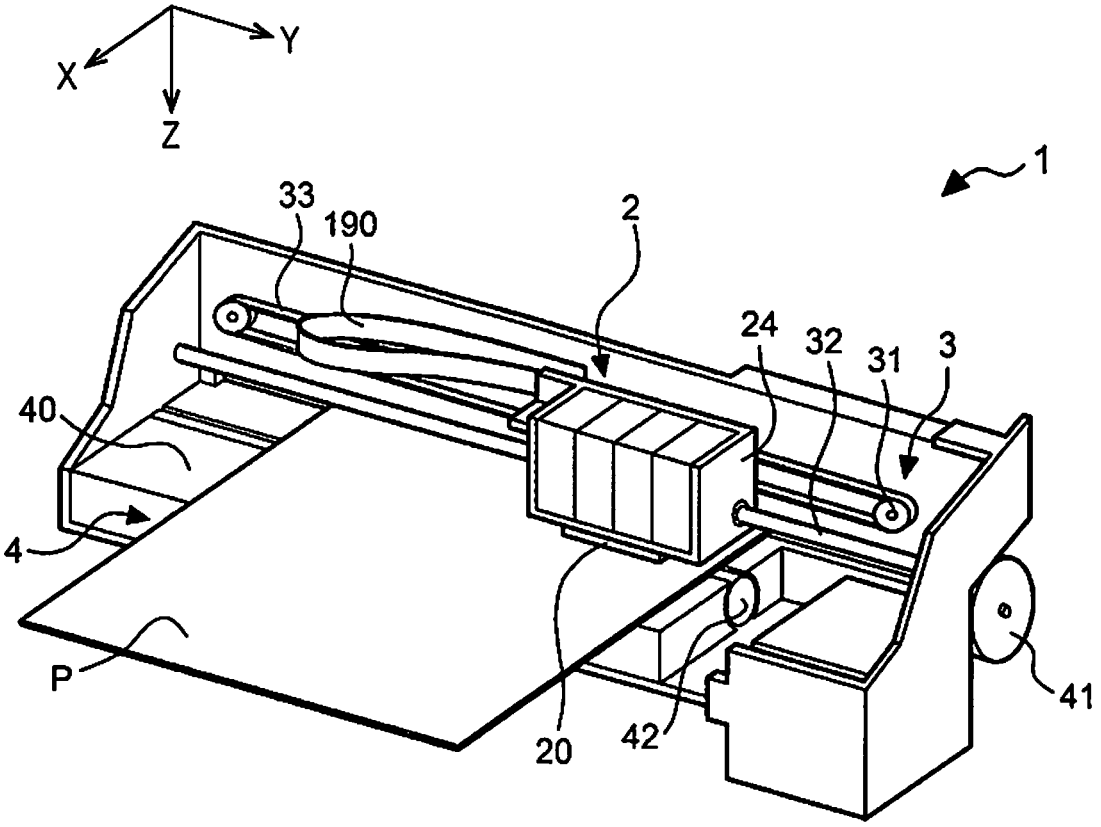
FIG. 1 is a perspective diagram showing a schematic configuration of a printing apparatus.

FIG. 1 is a perspective diagram showing a schematic configuration of a printing apparatus 1. FIG. 1 illustrates a direction X in which a medium P is transported, a direction Y in which a moving object 2 reciprocates and which intersects the direction X, and a direction Z in which ink is discharged. In the present embodiment, the direction X, the direction Y, and the direction Z are described as axes that are orthogonal to each other, which does not limit the present disclosure to have the various configurations of the printing apparatus 1 being arranged orthogonal to each other. Further, in the following description, the direction Y in which the moving object 2 moves may be referred to as a main scanning direction.

As shown in FIG. 1, the printing apparatus 1 includes the moving object 2 and a moving mechanism 3 that reciprocates the moving object 2 along the direction Y. The moving mechanism 3 has a carriage motor 31 that is a driving source of the moving object 2, a carriage guide shaft 32 that is fixed at both ends, and a timing belt 33 that extends substantially parallel to the carriage guide shaft 32 and is driven by the carriage motor 31.

A carriage 24 included in the moving object 2 is supported by the carriage guide shaft 32 so as to be reciprocally movable, and is fixed to a part of the timing belt 33. The carriage motor 31 drives the timing belt 33, thereby the carriage 24 is guided by the carriage guide shaft 32 and reciprocates along the direction Y. Further, a print head 20 having a plurality of nozzles is provided in a portion of the moving object 2 that faces the medium P. Various signals and the like are input to the print head 20 via a cable 190. Then, the print head 20 discharges ink as an example of a liquid from the nozzles based on the various input signals.

The printing apparatus 1 includes a transporting mechanism 4 that transports the medium P on a platen 40 along the direction X. The transporting mechanism 4 includes a transport motor 41 that is a driving source, and a transporting roller 42 that is rotated by the transport motor 41 and transports the medium P along the direction X. Further, at the timing when the medium P is transported by the transporting mechanism 4, an image is formed on the surface of the medium P by the print head 20 discharging ink.

Figure 2:
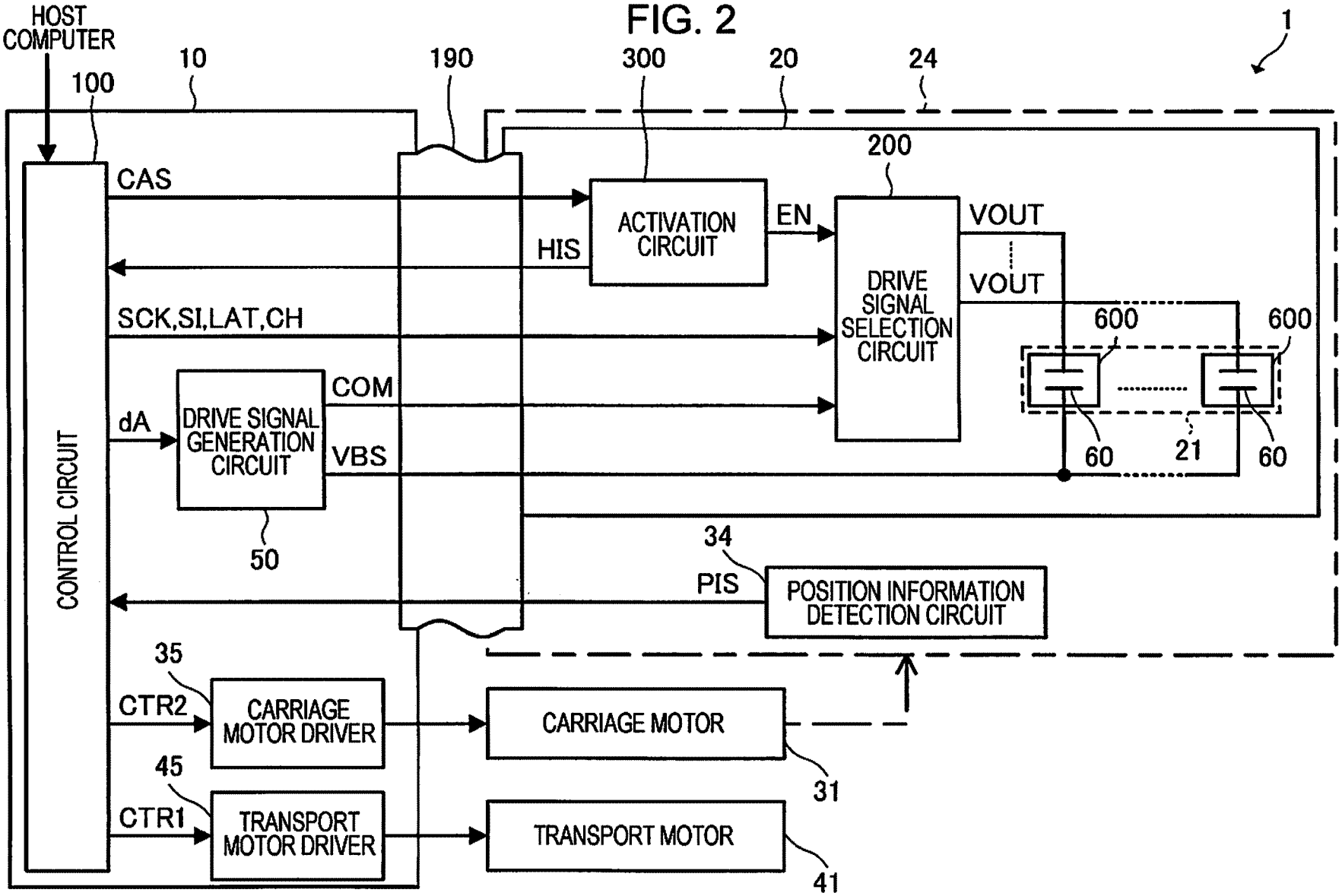
FIG. 2 is a block diagram showing an electrical configuration of the printing apparatus.

FIG. 2 is a block diagram showing an electrical configuration of the printing apparatus 1. As shown in FIG. 2, the printing apparatus 1 has a print head control circuit 10, a carriage motor 31, a transport motor 41, a print head 20, and a position information detection circuit 34. Among these, the print head 20 and the position information detection circuit 34 are mounted on the carriage 24. Various components mounted on the carriage 24 and the print head control circuit 10 are electrically coupled by a cable 190 such as a flexible flat cable (FFC).

The print head control circuit 10 includes a control circuit 100, a carriage motor driver 35, a transport motor driver 45, and a drive signal generation circuit 50.

The control circuit 100 outputs various signals for controlling the print head 20. Specifically, the control circuit 100 outputs a control signal CTR1 to the transport motor driver 45. The transport motor driver 45 controls a drive of the transport motor 41 in accordance with the input control signal CTR1. Thereby, the movement of the medium P in the direction X by the above described transporting mechanism 4 is controlled.

Further, the control circuit 100 outputs a control signal CTR2 to the carriage motor driver 35. The carriage motor driver 35 controls a drive of the carriage motor 31 in accordance with the input control signal CTR2. Thereby, the movement of the above described carriage 24 in the direction Y is controlled. In this case, the position information detection circuit 34 detects a position of the carriage 24. Then, the position information detection circuit 34 outputs the detected position of the carriage 24 in the direction Y to the control circuit 100 as a position information signal PIS.

Further, the control circuit 100 outputs a base drive signal dA that is a digital signal to the drive signal generation circuit 50. The drive signal generation circuit 50 performs digital/analog signal conversion on the input base drive signal dA and generates a drive signal COM by performing class-D amplification on the converted analog signal. Note that the base drive signal dA may be a signal that can define a waveform of the drive signal COM, and may be an analog signal. The drive signal generation circuit 50 only needs to be able to amplify the waveform defined by the base drive signal dA, and may include an amplification circuit such as a class-A amplification circuit, a class-B amplification circuit, or a class-AB amplification circuit.

The drive signal generation circuit 50 generates a reference voltage signal VBS indicating a reference potential of the drive signal COM. The reference voltage signal VBS may be, for example, a ground potential signal having a voltage value of 0V, or a DC voltage signal having a voltage value of 6V or the like.

Further, the control circuit 100 outputs a clock signal SCK, a print data signal SI, a latch signal LAT, a change signal CH, and an activation match signal CAS to the print head 20. Here, the latch signal LAT and the change signal CH are generated by the control circuit 100 based on the position information signal PIS indicating the scanning position of the carriage 24.

The print head 20 includes a drive signal selection circuit 200, an activation circuit 300, and a discharge head 21.

The activation match signal CAS is input to the activation circuit 300. The activation circuit 300 generates and outputs a discharge limiting signal EN based on the activation match signal CAS and an activation information signal CIS described later. Further, the activation circuit 300 outputs an individual information signal HIS indicating individual information HI of the print head 20 to the control circuit 100. Details of the activation circuit 300 will be described later.

The drive signal selection circuit 200 receives the clock signal SCK, the print data signal SI, the latch signal LAT, the change signal CH, the discharge limiting signal EN, and the drive signal COM. The drive signal selection circuit 200 selects or deselects a signal waveform included in the drive signal COM based on the clock signal SCK, the print data signal SI, the latch signal LAT, the change signal CH, and the discharge limiting signal EN. Then, the drive signal selection circuit 200 outputs the selected signal waveform to the discharge head 21 as a drive signal VOUT.

The discharge head 21 has a plurality of discharge units 600 and a plurality of piezoelectric elements 60 included in each of the plurality of discharge units 600. Each piezoelectric element 60 is supplied with a drive signal VOUT and a reference voltage signal VBS. The piezoelectric element 60 is driven according to a potential difference between the drive signal VOUT and the reference voltage signal VBS. As a result, a predetermined amount of ink is discharged from the discharge unit 600.

2. Configuration and Operation of Drive Signal Selection Control Circuit

Next, the configuration and operation of the drive signal selection circuit 200 will be described. First, an example of the drive signal COM supplied to the drive signal selection circuit 200 will be described with reference to FIG. 3. Thereafter, the configuration and operation of the drive signal selection circuit 200 will be described with reference to FIGS. 4 to 7.

Figure 3:
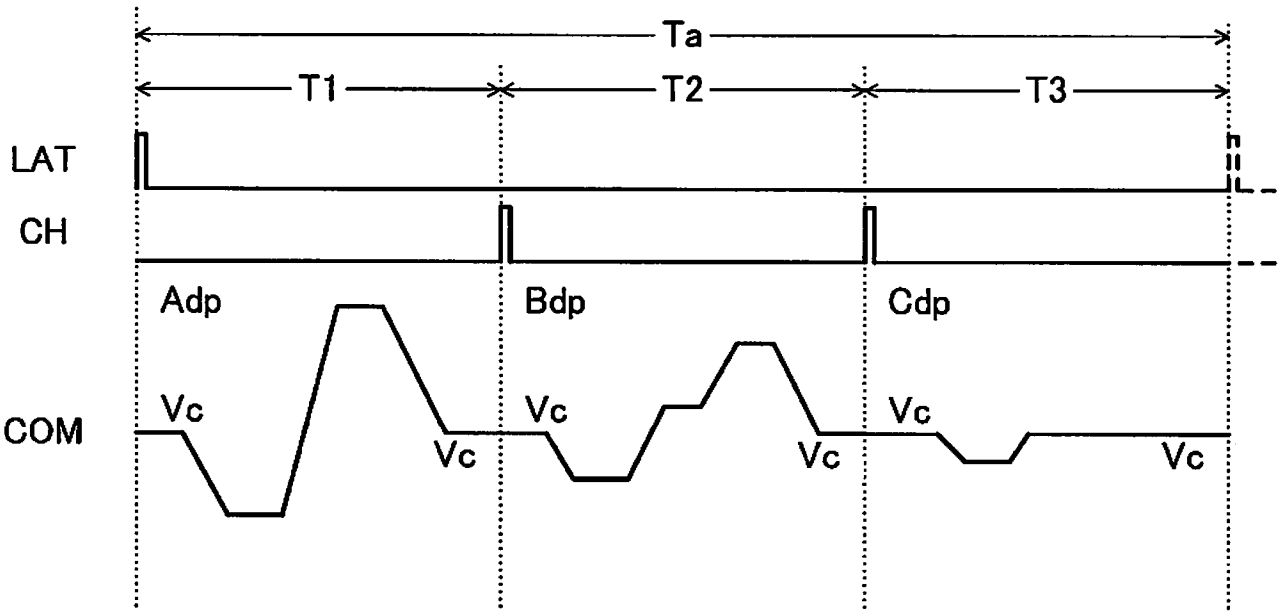
FIG. 3 is a diagram showing an example of a drive signal COM.

FIG. 3 is a diagram showing an example of a drive signal COM. FIG. 3 shows a term T1 from the rise of the latch signal LAT to the rise of the change signal CH, a term T2 after the term T1 until the next rise of the change signal CH, and a term T3 after the term T2 until the next rise of the latch signal LAT. Note that the period formed by the terms T1, T2, and T3 is a period Ta for forming a new dot on the medium P.

As shown in FIG. 3, the drive signal generation circuit 50 generates a trapezoidal waveform Adp in the term T1. When the trapezoidal waveform Adp is supplied to the piezoelectric element 60, a predetermined amount, specifically, a medium amount of ink is discharged from the corresponding discharge unit 600. Further, the drive signal generation circuit 50 generates a trapezoidal waveform Bdp in the term T2. When the trapezoidal waveform Bdp is supplied to the piezoelectric element 60, a small amount of ink smaller than the above described predetermined amount is discharged from the corresponding discharge unit 600. Further, the drive signal generation circuit 50 generates a trapezoidal waveform Cdp in the term T3. When the trapezoidal waveform Cdp is supplied to the piezoelectric element 60, the piezoelectric element 60 is displaced to the extent that ink is not discharged from the corresponding discharge unit 600. Therefore, no dots are formed on the medium P. The trapezoidal waveform Cdp is a signal waveform for preventing the viscosity of the ink from being increased by micro-vibrating the ink in the vicinity of the nozzle opening portion of the discharge unit 600. Note that in the following description, in order to prevent the viscosity of ink from being increased, displacing the piezoelectric element 60 to the extent that ink is not discharged from the discharge unit 600 may be referred to as "micro-vibration".

Here, a voltage value at the start timing and a voltage value at the end timing of the trapezoidal waveform Adp, the trapezoidal waveform Bdp, and the trapezoidal waveform Cdp are all in common voltage Vc. That is, the trapezoidal waveforms Adp, Bdp, and Cdp are signal waveforms in which a voltage value starts at voltage Vc and ends at voltage Vc. Therefore, the drive signal COM generated by the drive signal generation circuit 50 includes signal waveforms in which the trapezoidal waveforms Adp, Bdp, and Cdp are continuous in the period Ta.

Figure 4:
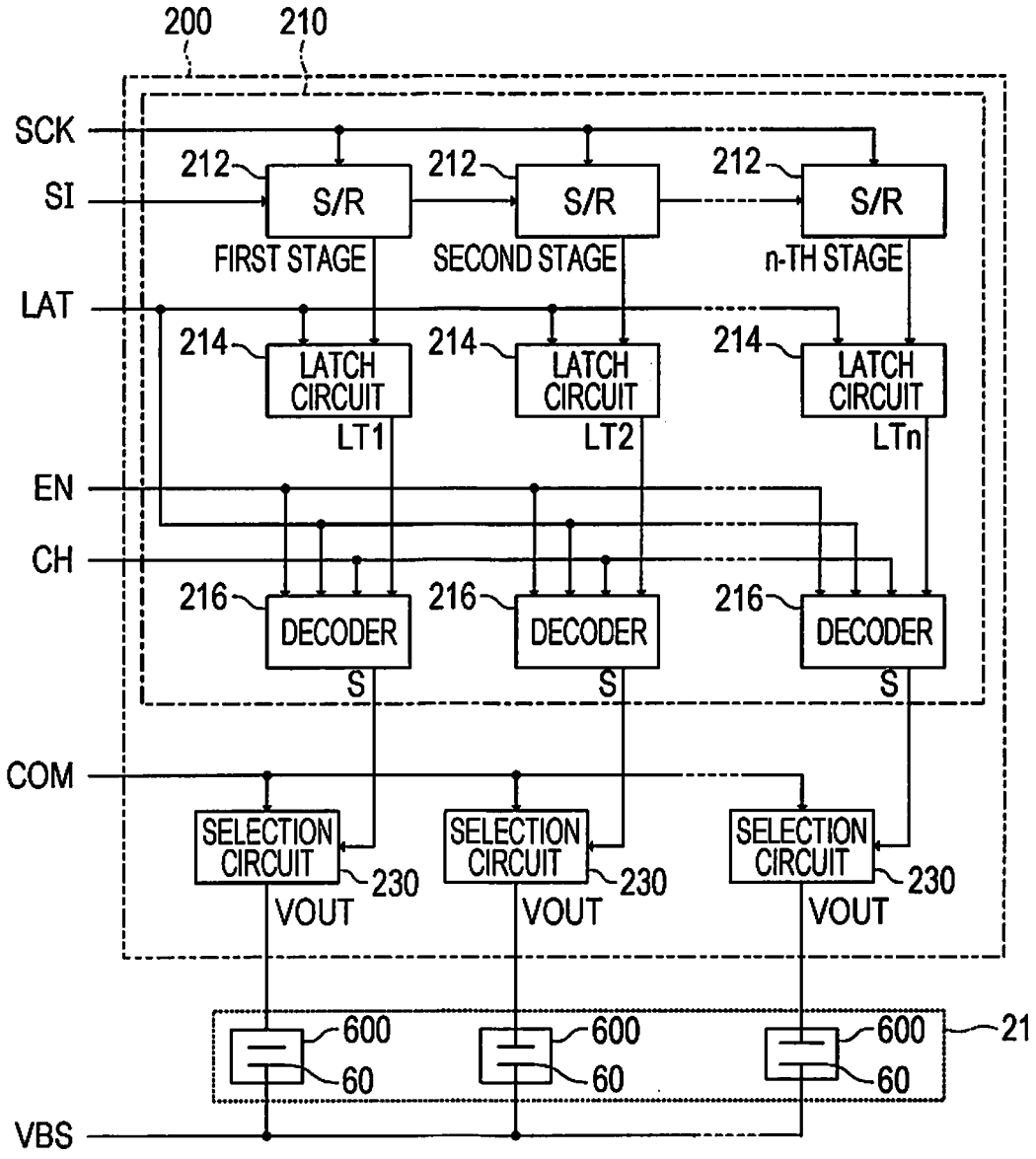
FIG. 4 is a block diagram showing an electrical configuration of a drive signal selection circuit.

FIG. 4 is a block diagram showing an electrical configuration of a drive signal selection circuit 200. The drive signal selection circuit 200 generates and outputs the drive signal VOUT in the period Ta by selecting or deselecting the trapezoidal waveforms Adp, Bdp, and Cdp included in the drive signal COM in each of the terms T1, T2, and T3. As shown in FIG. 4, the drive signal selection circuit 200 includes a selection control circuit 210 and a plurality of selection circuits 230.

The selection control circuit 210 receives a clock signal SCK, a print data signal SI, a latch signal LAT, a change signal CH, and a discharge limiting signal EN. In the selection control circuit 210, a set of a shift register 212 (S/R), a latch circuit 214, and a decoder 216 is provided corresponding to each of the discharge units 600. That is, in the print head 20, a set of a shift register 212, a latch circuit 214, and a decoder 216 is provided in the same number as the total number n of discharge units 600.

The shift register 212 holds 2-bit print data [SIH, SIL] included in the print data signal SI for each corresponding discharge unit 600. Specifically, the n-th stage of shift registers 212 corresponding to the discharge units 600 are coupled to each other in a cascade manner, and a serially supplied print data signal SI is sequentially transferred to the subsequent stage according to the clock signal SCK. In FIG. 4, in order to distinguish the shift registers 212, first, second, . . . , and n-th stages are indicated in order from the upstream to which the print data signal SI is supplied.

Each of the n latch circuits 214 latches the print data [SIH, SIL] held in the corresponding shift register 212 at the rise of the latch signal LAT. Each of the n decoders 216 decodes the 2-bit print data [SIH, SIL] latched by the corresponding latch circuit 214 to generate the selection signal S. The selection signal S is supplied to the selection circuit 230.

The selection circuit 230 is provided corresponding to each of the discharge units 600. That is, the number of selection circuits 230 included in one print head 20 is the same as the total number n of discharge units 600 included in the print head 20. The selection circuit 230 controls the supply of the signal waveform included in the drive signal COM to the piezoelectric element 60 based on the selection signal S supplied from the decoder 216.

Figures 5, 6:
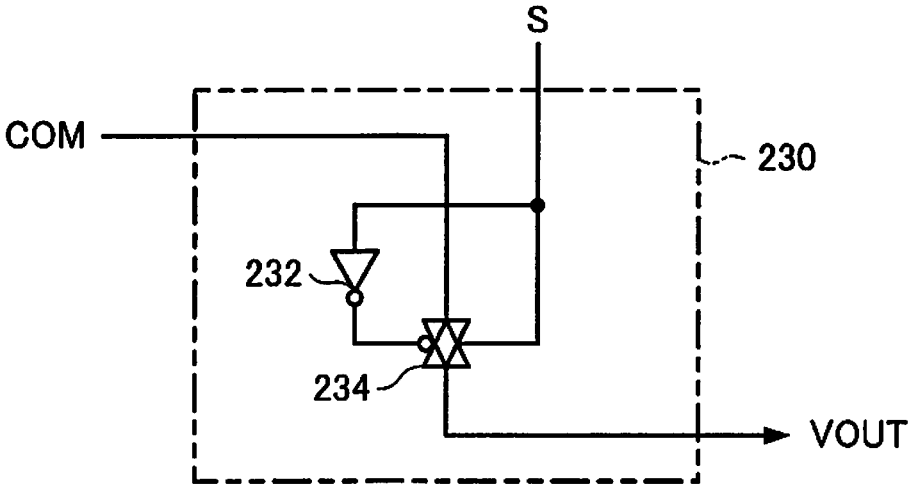
FIG. 5 is a diagram showing a configuration of a selection circuit.
FIG. 6 is a diagram showing decoding contents in a decoder.

FIG. 5 is a diagram showing a configuration of the selection circuit 230 corresponding to one discharge unit 600. As shown in FIG. 5, the selection circuit 230 has an inverter 232 and a transfer gate 234 that are NOT circuits.

The selection signal S is supplied to a positive control end of a transfer gate 234 that is not marked with a circle, is logically inverted by the inverter 232, and is also supplied to a negative control end of the transfer gate 234 marked with the circle. A drive signal COM is supplied to an input end of the transfer gate 234. The transfer gate 234 makes the input end and the output end conductive when the selection signal S is at the H level, and makes the input end and the output end non-conductive when the selection signal S is at the L level. Thereby, the drive signal VOUT is output from the output end of the transfer gate 234 to the discharge unit 600.

Next, the decoding contents of the decoder 216 will be described with reference to FIG. 6. FIG. 6 is a diagram showing decoding contents in a decoder 216. The decoder 216 receives a discharge limiting signal EN, 2-bit print data [SIH, SILL], a latch signal LAT, and a change signal CH.

Based on the logic level of the discharge limiting signal EN and the print data [SIH, SIL], the decoder 216 defines a logic level of the selection signal S output in each of the terms T1, T2, and T3 defined by the latch signal LAT and the change signal CH. For example, when the logic level of the discharge limiting signal EN is at the H level and the print data [SIH, SIL] is [1, 0], the decoder 216 outputs the selection signal S that becomes H, L, and L levels in the terms T1, T2, and T3.

Figure 7:
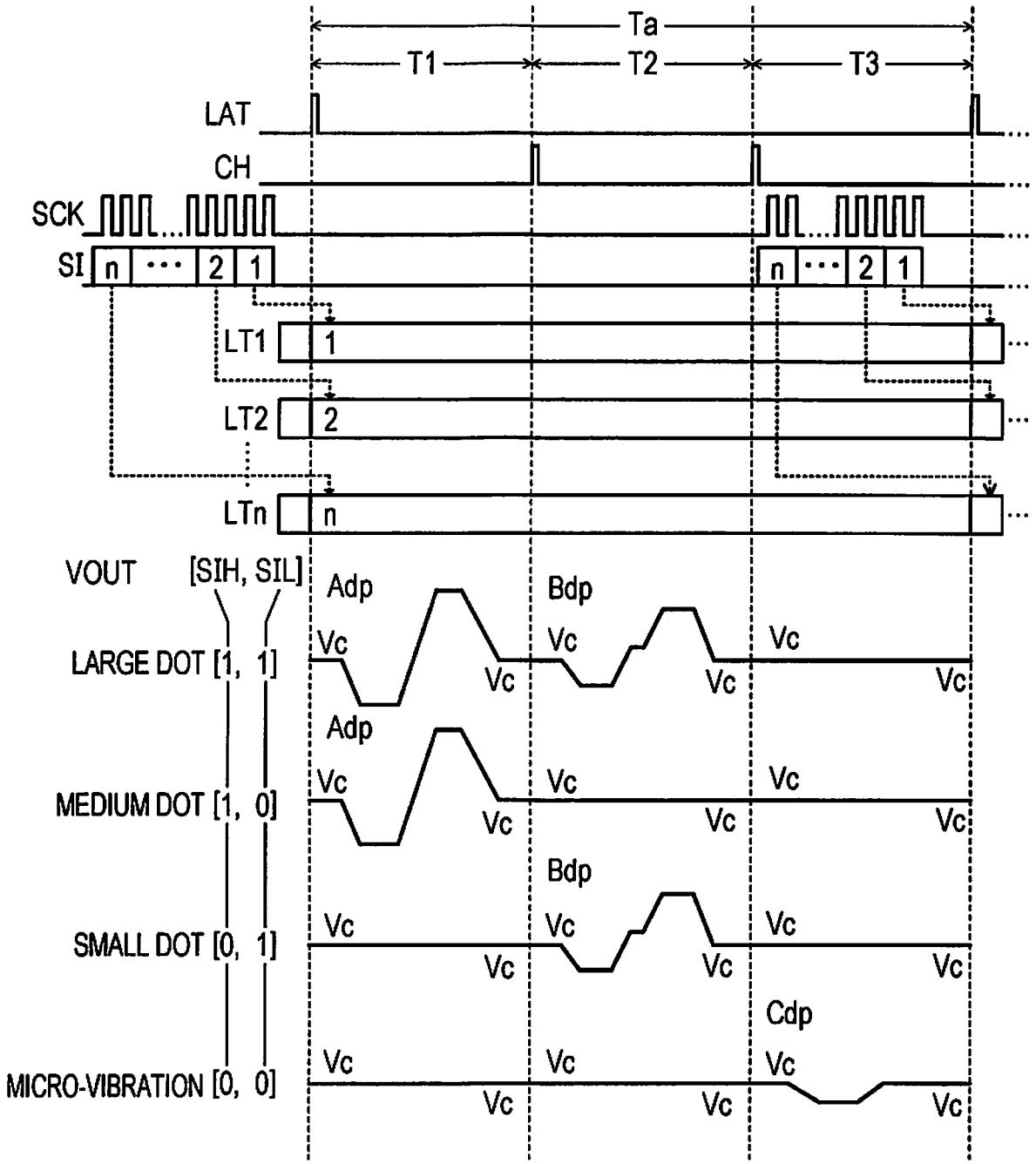
FIG. 7 is a diagram for explaining an operation of the drive signal selection circuit.

Details of the operation of generating the drive signal VOUT in the drive signal selection circuit 200 described above will be described with reference to FIG. 7. FIG. 7 is a diagram for explaining an operation of the drive signal selection circuit 200. As shown in FIG. 7, the print data signal SI is serially supplied to the drive signal selection circuit 200 in synchronization with the clock signal SCK, and sequentially transferred in the shift register 212 corresponding to the discharge unit 600. When the supply of the clock signal SCK is stopped, the print data [SIH, SIL] corresponding to the discharge unit 600 is held in each of the shift registers 212. The print data signal SI is supplied in the order corresponding to the last n-th, . . . , second, and first stages of the discharge unit 600 in the shift register 212.

When the latch signal LAT rises, each of the latch circuits 214 latches the print data [SIH, SIL] held in the corresponding shift register 212 at the same time. In FIG. 7, LT1, LT2, . . . , and LTn indicate print data [SIH, SIL] latched by the latch circuits 214 corresponding to the first, second, . . . , n-th stages of the shift register 212.

Based on the discharge limiting signal EN and the print data [SIH, SIL], the decoder 216 outputs a selection signal S at the logic level according to the contents shown in FIG. 6 in each of the terms T1, T2, and T3.

When the discharge limiting signal EN is at the H level and the print data [SIH, SIL] is [1, 1], the selection circuit 230 selects the trapezoidal waveform Adp in the term T1, selects the trapezoidal waveform Bdp in the term T2, and does not select the trapezoidal waveform Cdp in the term T3 according to the selection signal S output from the decoder 216. As a result, the drive signal VOUT corresponding to a large dot shown in FIG. 7 is generated. Further, when the discharge limiting signal EN is at the H level and the print data [SIH, SIL] is [1, 0], the selection circuit 230 selects the trapezoidal waveform Adp in the term T1, does not select the trapezoidal waveform Bdp in the term T2, and does not select the trapezoidal waveform Cdp in the term T3 according to the selection signal S output from the decoder 216. As a result, the drive signal VOUT corresponding to a medium dot shown in FIG. 7 is generated. Further, when the discharge limiting signal EN is at the H level and the print data [SIH, SIL] is [0, 1], the selection circuit 230 does not select the trapezoidal waveform Adp in the term T1, selects the trapezoidal waveform Bdp in the term T2, and does not select the trapezoidal waveform Cdp in the term T3 according to the selection signal S output from the decoder 216. As a result, the drive signal VOUT corresponding to a small dot shown in FIG. 7 is generated. Further, when the discharge limiting signal EN is at the H level and the print data [SIH, SIL] is [0, 0], the selection circuit 230 does not select the trapezoidal waveform Adp in the term T1, does not select the trapezoidal waveform Bdp in the term T2, and selects the trapezoidal waveform Cdp in the term T3 according to the selection signal S output from the decoder 216. As a result, the drive signal VOUT corresponding to a micro-vibration shown in FIG. 7 is generated.

Although not shown in FIG. 7, when the discharge limiting signal EN is at the L level, the selection circuit 230 does not select the trapezoidal waveform Adp in the term T1, does not select the trapezoidal waveform Bdp in the term T2, and does not select the trapezoidal waveform Cdp in the term T3 according to the selection signal S output from the decoder 216. As a result, a constant drive signal VOUT is generated at the voltage Vc.

As described above, the drive signal selection circuit 200 controls the discharge of ink from the nozzles. When the discharge limiting signal EN is at the H level, the drive signal selection circuit 200 generates the drive signal VOUT by selecting the signal waveform of the drive signal COM based on the print data signal SI and supplies the drive signal VOUT to the piezoelectric element 60. That is, when the discharge limiting signal EN is at the H level, the ink discharge control by the drive signal selection circuit 200 is limited to the ink discharge control based on the print data signal SI.

On the other hand, when the discharge limiting signal EN is at the L level, the drive signal selection circuit 200 generates the drive signal VOUT by selecting a predetermined signal waveform of the drive signal COM regardless of the print data signal SI and supplies the drive signal VOUT to the piezoelectric element 60. That is, when the discharge limiting signal EN is at the L level, the ink discharge control by the drive signal selection circuit 200 is limited to the ink discharge control based on a predetermined condition.

As described above, the ink discharge control by the drive signal selection circuit 200 is limited by the discharge limiting signal EN when the activation circuit 300 outputs the discharge limiting signal EN. In other words, the discharge limiting signal EN changes the limitation of ink discharge control by the drive signal selection circuit 200.

Note that in the drive signal selection circuit 200 described with reference to FIGS. 4 to 8, although it has been described that ink discharge control by the drive signal selection circuit 200 is limited by the decoder 216 to output the selection signal S at the L level regardless of the logic level of the print data [SIH, SIL] when the discharge limiting signal EN is at the L level, but the present disclosure is not limited to this. That is, when the discharge limiting signal EN is at the L level, the decoder 216 may output a selection signal S at a predetermined logic level defined in advance at a predetermined timing regardless of the logic level of the print data [SIH, SIL]. Specifically, when the discharge limiting signal EN is at the L level, the decoder 216 may be limited to output a selection signal S for printing a predetermined character or symbol defined in advance, on the medium P regardless of the logic level of the print data [SIH, SIL]. Further, when the discharge limiting signal EN is at the L level, the decoder 216 may limit the ink discharge control only for a selection signal S corresponding to nozzles of specific ink colors. Here, the piezoelectric element 60 is an example of a drive element, and the drive signal selection circuit 200 is an example of a discharge control circuit.

3. Configuration and Operation of Discharge Unit

Figure 8:
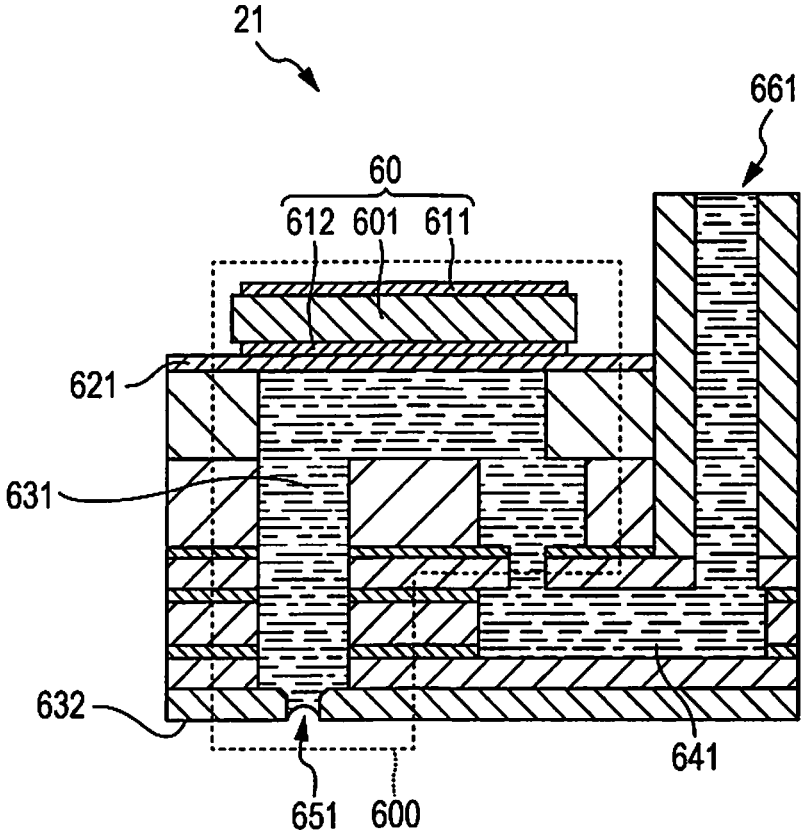
FIG. 8 is a cross-sectional diagram showing a schematic configuration of a discharge unit.

Next, the configuration and operation of the discharge unit 600 included in the discharge head 21 will be described. FIG. 8 is a cross-sectional diagram showing a schematic configuration of the discharge unit 600 obtained by cutting the discharge head 21 so as to include the discharge unit 600. As shown in FIG. 8, the discharge head 21 includes the discharge unit 600 and a reservoir 641.

Ink is introduced into the reservoir 641 from a supply port 661. The reservoir 641 is provided for each ink color.

The discharge unit 600 includes a piezoelectric element 60, a vibration plate 621, a cavity 631, and a nozzle 651. Among these, the vibration plate 621 is provided between the cavity 631 and the piezoelectric element 60, is displaced by driving the piezoelectric element 60 provided on the upper surface, and functions as a diaphragm that expands/reduces the internal volume of the cavity 631 in which ink is filled. The nozzle 651 is an opening portion provided on a nozzle plate 632 and communicating with the cavity 631. The cavity 631 functions as a pressure chamber in which the inside is filled with ink, and the internal volume changes due to the displacement of the piezoelectric element 60. The nozzle 651 communicates with the cavity 631 and discharges ink in the cavity 631 in accordance with a change in the internal volume of the cavity 631.

The piezoelectric element 60 has a structure in which a piezoelectric object 601 is sandwiched between a pair of electrodes 611 and 612. The drive signal VOUT is supplied to the electrode 611, and the reference voltage signal VBS is supplied to the electrode 612. The piezoelectric element 60 having such a structure is driven according to the potential difference between the electrode 611 and the electrode 612. As the piezoelectric element 60 is driven, the central portions of the electrodes 611 and 612 and the vibration plate 621 are displaced in the vertical direction with respect to both end portions, and ink is discharged from the nozzles 651 as the vibration plate 621 is displaced. That is, the discharge head 21 included in the print head 20 includes a piezoelectric element 60 that is driven by a potential difference between the electrode 611 to which the drive signal VOUT is supplied and the electrode 612 to which the reference voltage signal VBS is supplied, and ink is discharged from the nozzle 651 by driving the piezoelectric element 60.

Figure 9:
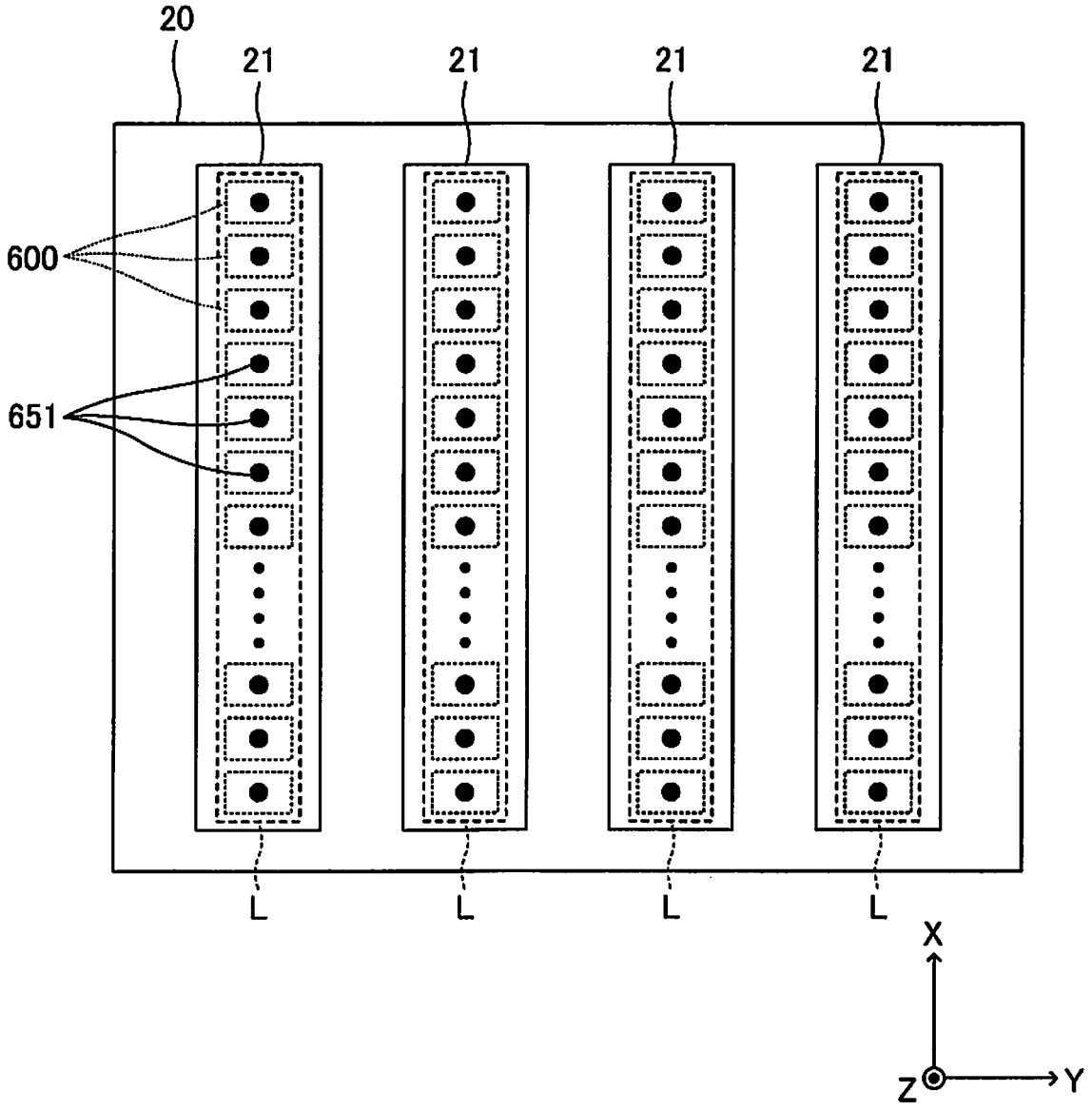
FIG. 9 is a diagram showing an example of an arrangement of a plurality of nozzles.

FIG. 9 is a diagram showing an example of an arrangement of a plurality of nozzles 651 provided in the discharge head 21 when the printing apparatus 1 is viewed in plan along the direction Z. Note that in FIG. 9, the print head 20 will be described as including four discharge heads 21.

As shown in FIG. 9, each discharge head 21 is formed with a nozzle line L configured with a plurality of nozzles 651 provided in a line-shape in a predetermined direction. Each nozzle line L is formed by n nozzles 651 arranged in a line-shape along the direction X. The nozzle line L shown in FIG. 9 is an example, and may have a different configuration. For example, in each nozzle line L, the n nozzles 651 may be arranged in a staggered manner so that the even-numbered nozzles 651 and the odd-numbered nozzles 651 from the end have different positions in the direction Y. Each nozzle line L may be formed in a direction different from the direction X. Further, each discharge head 21 may be formed with "2" or more nozzle lines L.

4. Configuration and Operation of Activation Circuit

Figure 10:
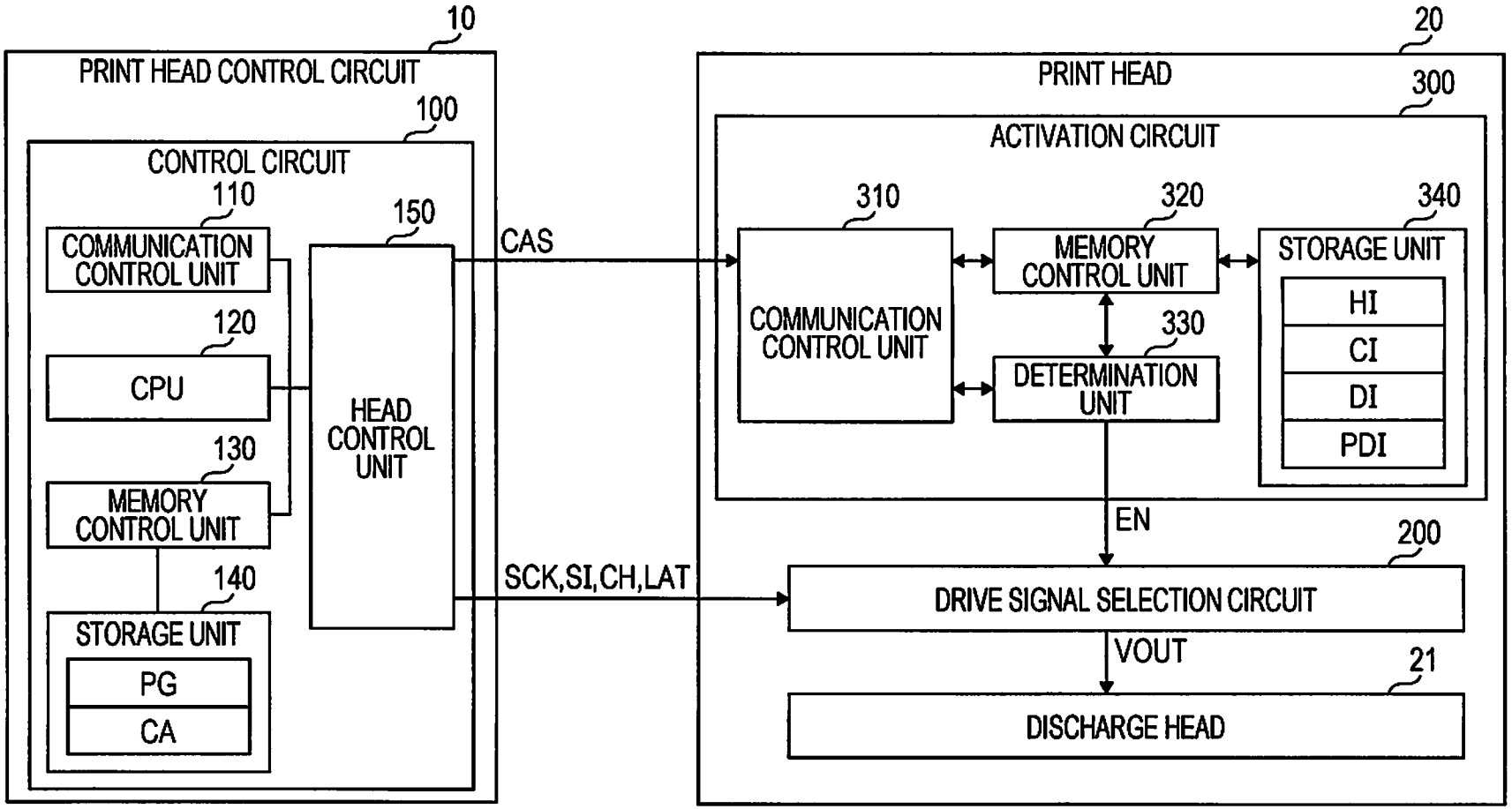
FIG. 10 is a diagram for explaining configuration and operation of an activation circuit.

In the printing apparatus 1 configured as described above, the configuration and operation of the activation circuit 300 included in the print head 20 will be described. FIG. 10 is a diagram for explaining the configuration and operation of the activation circuit 300.

As shown in FIG. 10, the control circuit 100 included in the print head control circuit 10 has a communication control unit 110, a CPU 120, a memory control unit 130, a storage unit 140, and a head control unit 150.

The communication control unit 110 controls communication between the printing apparatus 1 and the outside. For example, the communication control unit 110 controls communication between the printing apparatus 1 and an external host computer. Accordingly, various signals such as image data are input to the printing apparatus 1 from the host computer.

The storage unit 140 stores a control program PG for controlling the printing apparatus 1. The control program PG stored in the storage unit 140 is read by a memory control unit 130 and executed by the CPU 120. The CPU 120 executes processing based on the control program PG, so that the head control unit 150 generates a clock signal SCK, a print data signal SI, a change signal CH, and a latch signal LAT based on the image data input from the host computer and the position information signal PIS described above, and outputs the generated signals to the drive signal selection circuit 200.

The storage unit 140 stores activation match information CA for determining whether or not the electrical coupling between the print head control circuit 10 and the print head 20 is possible. The activation match information CA is read by the memory control unit 130. The activation match information CA read by the memory control unit 130 is output to the activation circuit 300 via the head control unit 150 as an activation match signal CAS. Note that the activation match information CA is not limited to the generation by the above procedure, and may be generated based on a plurality of information such as the activation information CI, random number information, individual information HI, for example.

The print head 20 has an activation circuit 300, a drive signal selection circuit 200, and a discharge head 21. The activation circuit 300 has a communication control unit 310, a memory control unit 320, a determination unit 330, and a storage unit 340. The storage unit 340 is an example of a memory circuit, the communication control unit 310 is an example of a communication control circuit, and the determination unit 330 is an example of a limiting circuit.

The storage unit 340 stores the individual information HI of the print head 20, the activation information CI based on the individual information HI, the discharge control information DI, and the permanent discharge control information PDI.

The individual information HI may include information for individually identifying the print head 20 such as a production number, a production lot, and a serial number of the print head 20. The individual information HI may be information indicating individual characteristics of the print head 20 such as ink discharge characteristics from the discharge unit 600, or an optimum voltage value, maximum voltage value, and frequency of the drive signal COM for driving the piezoelectric element 60, or drive characteristics of the discharge unit 600 and the piezoelectric element 60.

The activation information CI is information generated corresponding to the individual information HI. For example, the activation information CI is generated by performing specific signal processing on the individual information HI. The print head 20 determines whether or not the connection with the print head control circuit 10 is possible based on the activation information CI and the activation match information CA included in the activation match signal CAS. Further, the discharge control information DI and the permanent discharge control information PDI include information for limiting ink discharge control in the drive signal selection circuit 200.

The memory control unit 320 reads the activation information CI, the discharge control information DI, and the permanent discharge control information PDI, which are stored in the storage unit 340. Here, the individual information HI, the activation information CI, the discharge control information DI, and the permanent discharge control information PDI are output as an individual information signal HIS, an activation information signal CIS, a discharge control information signal DIS, and a permanent discharge control information signal PDIS, respectively.

The communication control unit 310 controls communication between the print head 20 and the outside of the print head 20. For example, in FIG. 10, the communication control unit 310 is communicably connected to the control circuit 100. Then, the communication control unit 310 inputs the activation match signal CAS which is input from the control circuit 100 to the determination unit 330. Further, communication control unit 310 is communicably connected to an activation information generation unit 700 described later. That is, at least one of the print head control circuit 10, the activation information generation unit 700 described later, and the activation information generation unit connection terminal 710*a* in the printing apparatus 1 is an example of a device provided outside the print head 20. The communication control unit 310 controls communication with each of these components.

The determination unit 330 receives an activation match signal CAS including activation match information CA, an activation information signal CIS including activation information CI, a discharge control information signal DIS including discharge control information DI, and a permanent discharge control information signal PDIS including permanent discharge control information PDI. The determination unit 330 determines whether or not the activation match information CA is a signal corresponding to the activation information CI based on the individual information HI. Then, the determination unit 330 generates a discharge limiting signal EN based on the determination result, the discharge control information DI, and the permanent discharge control information PDI. The activation information CI based on the individual information HI is an example of individual activation information, and the activation information generation unit 700 is an example of an individual activation information generation circuit.

Here, with reference to FIG. 11, the relationship between the activation match information CA, activation information CI, discharge control information DI, and permanent discharge control information PDI which are input to the determination unit 330, and the discharge limiting signal EN generated by the determination unit 330 will be described. The determination unit 330 in the present embodiment changes the limitation of ink discharge control by the drive signal selection circuit 200 when a signal according to the activation information CI is input from the outside.

FIG. 11 is a diagram showing an example of the discharge limiting signal EN generated by the determination unit 330. As shown in FIG. 11, when the permanent discharge control information PDI indicates the H level and the discharge control information DI indicates the H level, the determination unit 330 outputs a discharge limiting signal EN at the H level. Further, when the permanent discharge control information PDI indicates the H level and the discharge control information DI indicates the L level, the determination unit 330 outputs a discharge limiting signal EN at the L level.

That is, when the permanent discharge control information PDI indicates the H level, the determination unit 330 determines a logic level of the discharge limiting signal EN based on the logic level of the discharge control information DI. Here, the discharge control information DI is rewritten to the H level by the memory control unit 320 when a signal including the activation match information CA according to the activation information CI is input from the outside.

In the activation circuit 300 configured as described above, in the initial state of the print head 20, the ink discharge control by the drive signal selection circuit 200 is limited to the discharge control based on a condition defined in advance by storing the discharge control information DI indicating the L level in the storage unit 340. When the activation match signal CAS including the activation match information CA corresponding to the activation information CI based on the individual information HI is input from the print head control circuit 10 to the print head 20, the discharge control information DI stored in the storage unit 340 is rewritten to the H level. Thereby, the ink discharge control by the drive signal selection circuit 200 is limited to the ink discharge control based on the print data signal SI. That is, whether the limitation on the ink discharge control by the drive signal selection circuit 200 is limited based on the print data signal SI or limited based on a condition defined in advance, is changed based on whether or not the activation match information CA input to the determination unit 330 is information corresponding to the activation information CI.

Further, when the permanent discharge control information PDI indicates the L level, the discharge control information DI indicates the H level, and the activation match information CA is a signal corresponding to the activation information CI, the determination unit 330 outputs a discharge limiting signal EN at the H level. Further, when the permanent discharge control information PDI indicates the L level, the discharge control information DI indicates the H level, and the activation match information CA is not a signal corresponding to the activation information CI, the determination unit 330 outputs a discharge limiting signal EN at the L level. Further, when the permanent discharge control information PDI indicates the L level, the discharge control information DI indicates the L level, regardless of whether or not the activation match information CA is a signal corresponding to the activation information CI, the determination unit 330 outputs a discharge limiting signal EN at the L level.

That is, when the permanent discharge control information PDI indicates the L level, the determination unit 330 determines a logic level of the discharge limiting signal EN based on the logic level of the discharge control information DI and whether or not the activation match information CA is a signal corresponding to the activation information CI. Here, the discharge control information DI is rewritten to the H level by the memory control unit 320 when a signal including the activation match information CA according to the activation information CI is input from the outside.

In the activation circuit 300 configured as described above, in the initial state of the print head 20, the ink discharge control by the drive signal selection circuit 200 is limited to the discharge control based on a condition defined in advance by storing the discharge control information DI indicating the L level in the storage unit 340. When the activation match signal CAS including the activation match information CA corresponding to the activation information CI based on the individual information HI is input from the print head control circuit 10 to the print head 20, the discharge control information DI stored in the storage unit 340 is rewritten to the H level. Thereby, when the activation match information CA, which is input, is information corresponding to the activation information CI, the determination unit 330 outputs the discharge limiting signal EN at the H level. Further, when the activation match information CA, which is input, is not information corresponding to the activation information CI, the determination unit 330 outputs the discharge limiting signal EN at the L level. That is, whether the limitation on the ink discharge control by the drive signal selection circuit 200 is limited based on the print data signal SI or limited based on a condition defined in advance, is changed based on whether or not the activation match information CA input to the determination unit 330 is information corresponding to the activation information CI.

Here, in the description of FIG. 11, the discharge control information DI and the permanent discharge control information PDI include binary information of the H level or L level, and the discharge limiting signal EN is a binary signal of H level and L level. However, the present disclosure is not limited to this. For example, the discharge control information DI and the permanent discharge control information PDI may be information having a plurality of bits, and the discharge limiting signal EN may be a signal including information of a plurality of bits in serial or parallel. As a result, various limitations can be imposed on the ink discharge control by the drive signal selection circuit 200.

5. Configuration and Activation Operation of Print Head and Printing Apparatus Activation System Here, the configuration and operation of an activation system including at least one of the printing apparatus 1 having the print head 20 that includes the above described activation circuit 300 and the print head 20, and activation information generation unit 700 will be described.

Figure 12:
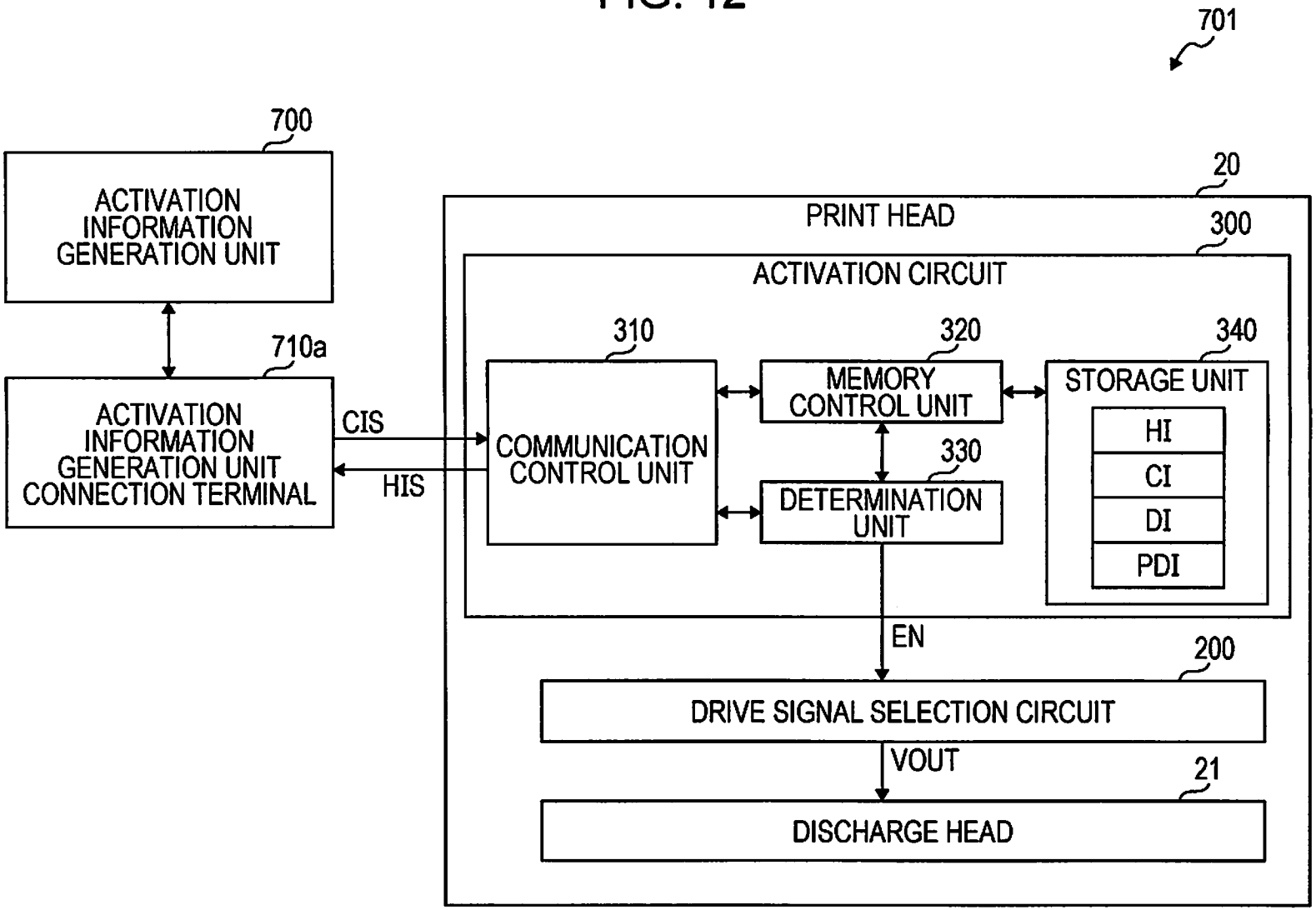
FIG. 12 is a diagram showing a configuration of a print head activation system.

First, a print head activation system 701 that enables activation of the print head 20 by storing the activation information CI in the storage unit 340 of the print head 20 will be described with reference to FIGS. 12 and 13. FIG. 12 is a diagram showing a configuration of a print head activation system 701.

As shown in FIG. 12, the print head activation system 701 has a print head 20 having an activation circuit 300, an activation information generation unit 700, and an activation information generation unit connection terminal 710*a*.

The print head 20 is communicably connected to an activation information generation unit 700 via an activation information generation unit connection terminal 710*a*. Specifically, the print head 20 is communicably connected to the activation information generation unit connection terminal 710*a*. In addition, the activation information generation unit connection terminal 710*a* is communicably connected to the activation information generation unit 700. Thereby, the individual information HI stored in the print head 20 is input to the activation information generation unit 700 as an individual information signal HIS. Then, the activation information generation unit 700 generates activation information CI based on the individual information HI included in the individual information signal HIS, and outputs the activation information CI to the print head 20 as an activation information signal CIS.

Here, the activation information generation unit connection terminal 710*a* is a relay terminal for communicably connecting the activation information generation unit 700 and the print head 20, and controls communication between the activation information generation unit 700 and the print head 20. In addition, the activation information generation unit 700 may be a server provided on a communication network, for example. The activation information generation unit 700 and the activation information generation unit connection terminal 710*a* may be communicably connected with each other with wire or wireless by being connected using a LAN cable, wireless communication, or the like.

Figure 13:
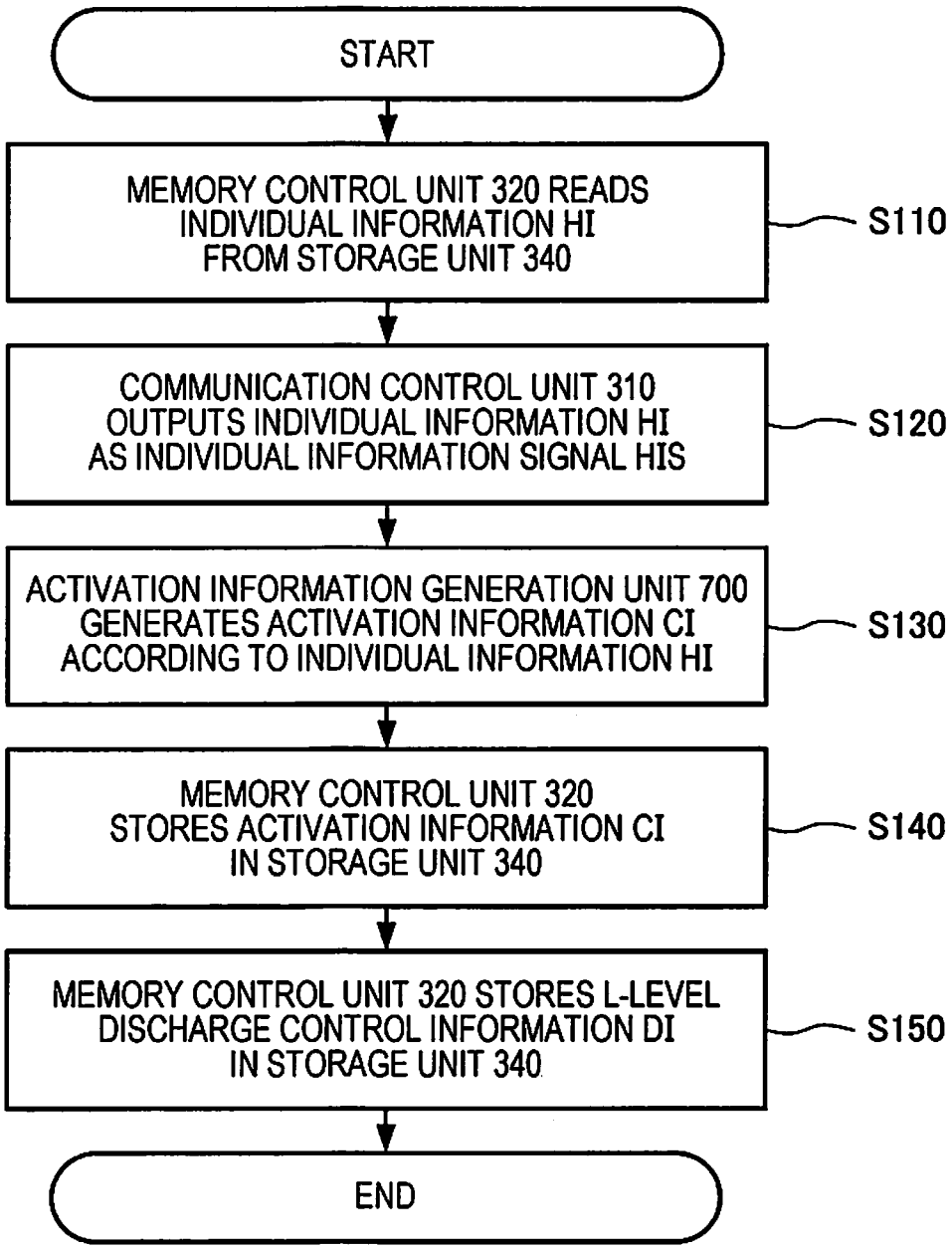
FIG. 13 is a flowchart diagram showing an operation of the print head activation system.

FIG. 13 is a flowchart diagram showing an operation of the print head activation system 701. First, the activation information generation unit 700 is communicably connected to the print head 20 via the activation information generation unit connection terminal 710*a*, thereby the memory control unit 320 is controlled via the communication control unit 310. The memory control unit 320 reads the individual information HI from the storage unit 340 (step S110). The communication control unit 310 outputs the individual information HI read by the memory control unit 320 as an individual information signal HIS (step S120). The individual information signal HIS is input to the activation information generation unit 700 via the activation information generation unit connection terminal 710*a*. Here, the activation information generation unit connection terminal 710*a* may output the individual information signal HIS to the activation information generation unit 700, and may output a specific signal obtained by encrypting the individual information signal HIS to the activation information generation unit 700.

The activation information generation unit 700 generates activation information CI according to the individual information HI included in the individual information signal HIS (step S130). The activation information CI is input to the print head 20 via the activation information generation unit connection terminal 710*a* as an activation information signal CIS.

The memory control unit 320 stores the activation information CI included in the activation information signal CIS in the storage unit 340 (step S140). As a result, the activation information CI according to the individual information HI is stored in the storage unit 340 of the print head 20. Thereafter, the memory control unit 320 stores the discharge control information DI indicating the L level in the storage unit 340 (step S150). That is, when new activation information CI is stored in the storage unit 340, the discharge control information DI indicating L level is stored in the storage unit 340. The print head activation system 701 configured as described above is an example of an activation system.

Figure 14:
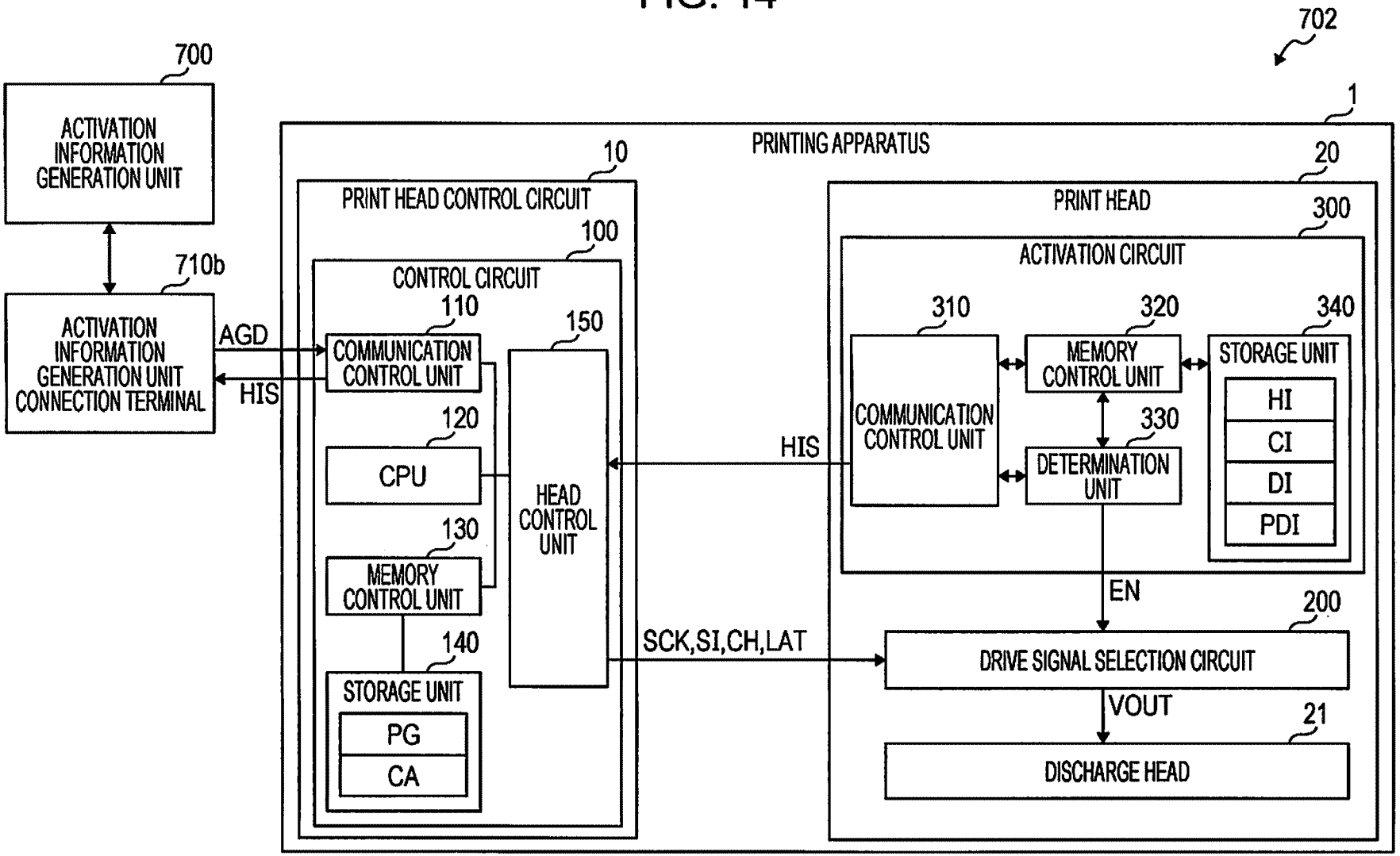
FIG. 14 is a diagram showing a configuration of a printing apparatus activation system.

Next, a printing apparatus activation system 702 that performs activation of the print head 20 and the print head control circuit 10 by storing the activation match information CA according to the activation information CI to the storage unit 140 of the print head control circuit 10, will be described with reference to FIGS. 14 and 15. FIG. 14 is a diagram showing a configuration of a printing apparatus activation system 702.

As shown in FIG. 14, the printing apparatus activation system 702 has the printing apparatus 1, the activation information generation unit 700, and an activation information generation unit connection terminal 710*b*. Further, the printing apparatus 1 includes a print head 20 having an activation circuit 300 and a print head control circuit 10 communicably connected to the print head 20.

The printing apparatus 1 is communicably connected to the activation information generation unit 700 via an activation information generation unit connection terminal 710*b*. Specifically, the printing apparatus 1 is communicably connected to the activation information generation unit connection terminal 710*b*. In addition, the activation information generation unit connection terminal 710*b* is communicably connected to the activation information generation unit 700. Thereby, the individual information HI stored in the print head 20 included in the printing apparatus 1 is input to the activation information generation unit 700 as an individual information signal HIS. Then, the activation information generation unit 700 generates activation match information CA based on the individual information HI included in the individual information signal HIS, and outputs the activation match information CA to the print head control circuit 10 as an activation match signal CAS.

Here, the activation information generation unit connection terminal 710*b* is a relay terminal for communicably connecting the activation information generation unit 700 and the printing apparatus 1, and further controls communication between the activation information generation unit 700 and the printing apparatus 1. The activation information generation unit connection terminal 710*b* and the activation information generation unit connection terminal 710*a* may be a common terminal, or may be different terminals dedicated to each.

Figure 15:
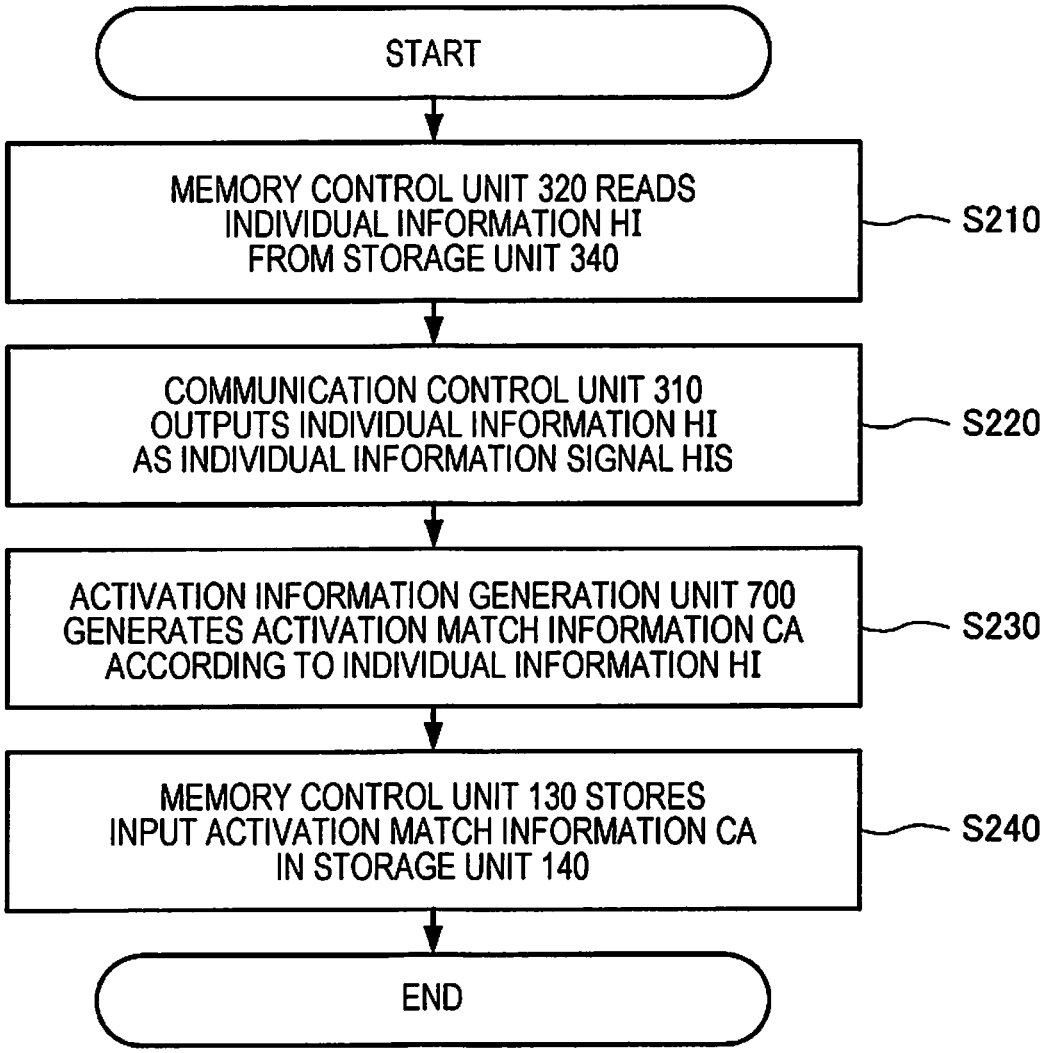
FIG. 15 is a flowchart diagram showing an operation of the printing apparatus activation system.

FIG. 15 is a flowchart diagram showing an operation of the printing apparatus activation system 702. The activation information generation unit 700 is communicably connected to the printing apparatus 1 via the activation information generation unit connection terminal 710*b*. Thereby, the memory control unit 320 included in the print head 20 is controlled. The memory control unit 320 reads the individual information HI from the storage unit 340 (step S210). The communication control unit 310 outputs the individual information HI read by the memory control unit 320 as an individual information signal HIS (step S220). The individual information signal HIS is input to the activation information generation unit 700 via the print head control circuit 10 and the activation information generation unit connection terminal 710*b*. Here, the activation information generation unit connection terminal 710*b* may output the activation information generation unit 700 without converting the individual information signal HIS, or may output the activation information generation unit 700 after converting the individual information signal HIS into a specific signal.

The activation information generation unit 700 generates activation match information CA according to the individual information HI included in the individual information signal HIS (step S230). The activation match information CA is input to the print head control circuit 10 via the activation information generation unit connection terminal 710*b* as an activation match signal CAS.

The memory control unit 130 stores the activation match information CA in the storage unit 140 (step S240). As a result, the activation match information CA according to the individual information HI is stored in the storage unit 140 of the print head control circuit 10. Here, the activation information CI stored in the storage unit 340 of the print head 20 is information according to the individual information HI as described above. Therefore, the activation match information CA stored in the storage unit 140 is also a signal according to the activation information CI stored in the storage unit 340 of the print head 20.

Here, the activation match information CA may be the same information as the activation information CI, or may include information indicating a correction value of the print head control circuit 10 calculated based on the individual information HI of the print head 20. Further, when the print head control circuit 10 cannot generate various control signals and drive signals COM that can satisfy the accuracy of ink discharged from the connected print head 20, that is, when the drive characteristics of the print head 20 are outside the specification range of the print head control circuit 10, the activation match information CA may include predetermined error information regardless of the individual information HI.

In the printing apparatus activation system 702 configured as described above, the activation information generation unit 700 is communicably connected to the print head control circuit 10 and is also communicably connected to the print head 20 via the print head control circuit 10. Further, in the printing apparatus activation system 702, in step S230 shown in FIG. 15, the activation information generation unit 700 may generate the activation match information CA according to the individual information HI and also generate the activation information CI. Then, the activation information generation unit 700 may output the activation match information CA to the print head control circuit 10 as the activation match signal CAS, and output the activation information CI to the print head 20 as the activation information signal CIS. That is, in the printing apparatus activation system 702, the activation information generation unit 700 may be provided so as to be communicable with the print head 20, and may generate activation information CI according to the individual information HI. Here, the printing apparatus activation system 702 is another example of the activation system.

Figure 16:
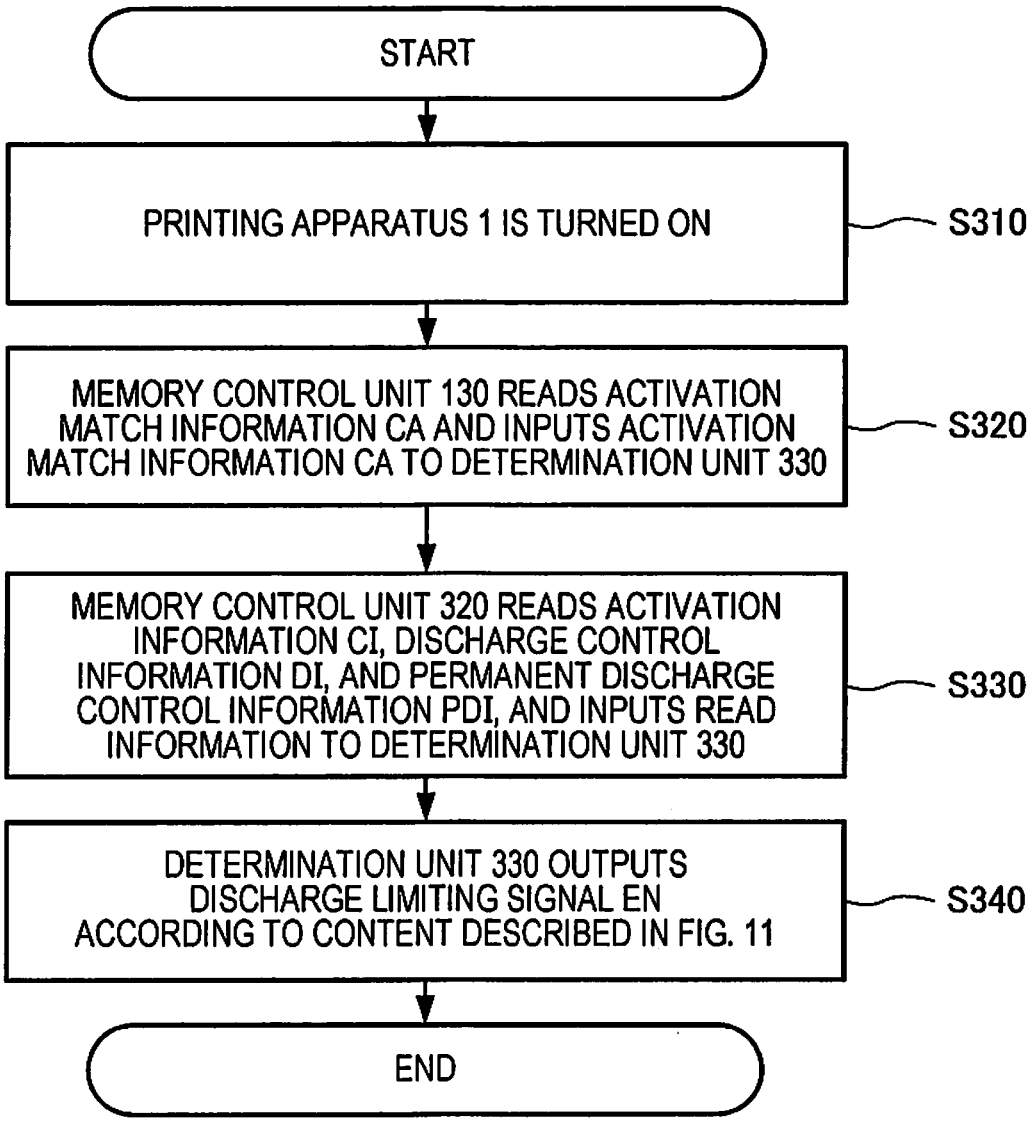
FIG. 16 is a flowchart diagram for explaining an operation of the printing apparatus in which activation information and activation match information according to the activation information are stored.

The operation of the printing apparatus 1 in which the activation information CI and the activation match information CA are recorded by the above described print head activation system 701 and the printing apparatus activation system 702 will be described with reference to FIG. 16. FIG. 16 is a flowchart diagram for explaining an operation of the printing apparatus 1 in which activation information CI and activation match information CA according to the activation information CI are stored.

When the printing apparatus 1 is turned on (step S310), the memory control unit 130 reads activation match information CA and inputs the activation match information CA to the determination unit 330 (step S320). Specifically, the memory control unit 130 reads the activation match information CA stored in the storage unit 140. The memory control unit 130 inputs the activation match information CA to the determination unit 330 via the head control unit 150 and the communication control unit 310 as the activation match signal CAS.

Further, the memory control unit 320 reads the activation information CI, the discharge control information DI, and the permanent discharge control information PDI and inputs the read information to the determination unit 330 (step S330). Specifically, the memory control unit 320 reads the activation information CI, the discharge control information DI, and the permanent discharge control information PDI stored in the storage unit 340, and inputs the read information to the determination unit 330 as the activation information signal CIS, the discharge control information signal DIS, and the permanent discharge control information signal PDIS. Note that above described step S320 and step S330 may be performed simultaneously or in reverse order.

The activation match information CA, the activation information CI, the discharge control information DI, and the permanent discharge control information PDI are input to the determination unit 330. Then, the determination unit 330 outputs the discharge limiting signal EN according to the content described in FIG. 11 (step S340). Accordingly, the ink discharge control by the drive signal selection circuit 200 included in the print head 20 is limited according to the activation status of the print head control circuit 10 and the print head 20. That is, when the activation of the print head 20 connected to the print head control circuit 10 is abnormal, the print head 20 is limited to predetermined discharge control defined in advance, and when the activation of the print head 20 connected to the print head control circuit 10 is normal, the print head 20 executes print control limited by the print data signal SI.

6. Operation Effect

As described above, the print head 20 according to the present embodiment stores the individual information HI and the activation information CI based on the individual information HI in the storage unit 340. When a signal according to the activation information CI is input to the determination unit 330, the determination unit 330 changes the limitation on ink discharge control from the drive signal selection circuit 200. As described above, the print head 20 stores the individual information HI and the activation information CI based on the individual information HI. Further, in the print head 20 itself, it is possible to apply the more suitable limitation to the ink discharge control in the drive signal selection circuit 200 by determining whether or not the information input from the outside is information based on the activation information CI. Therefore, even when the print head 20 is replaced, activation can be performed based on the discharge characteristics and specifications of the print head 20 after the replacement. Further, even when the specifications of the print head 20 are different before and after the replacement, the possibility that the printing quality is lowered due to the variation in the discharge characteristics of the print head 20 is reduced, and the possibility that the printing apparatus 1 breaks down is also reduced.

The print head 20 in the present embodiment stores the individual information HI and activation information CI. The activation information CI based on the individual information HI is generated by an activation information generation unit 700 provided outside. That is, the activation information CI based on the individual information HI is generated outside the print head 20. Therefore, it is not necessary to hold a program for generating the activation information CI based on the individual information HI in the print head 20, and thus the storage capacity of the storage unit 340 of the print head 20 can be reduced.

As mentioned above, although embodiment and the modification were demonstrated, the present disclosure is not limited to these embodiments and can be implemented in various modes without departing from the gist thereof. For example, the above-described embodiments can be appropriately combined.

The present disclosure includes configurations that are substantially the same as the configurations described in the embodiments (for example, configurations that have the same functions, methods, and results, or configurations that have the same objects and effects). The present disclosure includes a configuration in which a non-essential part of the configuration described in the embodiment is replaced. The present disclosure includes a configuration that exhibits the same operational effects as the configuration described in the embodiment or a configuration that can achieve the same object. In addition, the present disclosure includes a configuration in which a known technique is added to the configuration described in the embodiment.

What is claimed is:

1. A print head discharging a liquid from a nozzle, comprising:

a memory circuit that stores individual information of the print head and individual activation information based on the individual information;

a communication control circuit that controls communication between the print head and an outside;

a discharge control circuit that controls discharge of the liquid; and a limiting circuit that limits liquid discharge control by the discharge control circuit, wherein when a signal according to the individual activation information is input from the outside, the limiting circuit changes a limitation of liquid discharge control by the discharge control circuit, the memory circuit stores discharge control information that is information for limiting liquid discharge control by the discharge control circuit, and the discharge control information is rewritten when a signal according to the individual activation information is input from the outside.

2. The print head according to claim 1, wherein the individual information includes a production number of the print head.

3. The print head according to claim 1, wherein the individual information includes a serial number of the print head.

4. The print head according to claim 1, further comprising a drive element that is driven to cause the nozzle to discharge the liquid, wherein the individual information includes drive characteristics of the drive element.

5. The print head according to claim 4, wherein the drive characteristics include a maximum voltage value of a drive signal for driving the drive element.

6. An activation system comprising:

a print head discharging a liquid from a nozzle; and an individual activation information generation circuit, wherein the print head has a memory circuit that stores individual information of the print head and individual activation information based on the individual information, a communication control circuit that controls communication between the print head and an outside, a discharge control circuit that controls discharge of the liquid, and a limiting circuit that limits liquid discharge control by the discharge control circuit, the individual activation information generation circuit is configured to communicate with the print head, and generates the individual activation information based on the individual information, and when a signal according to the individual activation information is input from the outside, the limiting circuit changes a limitation of liquid discharge control by the discharge control circuit, the memory circuit stores discharge control information that is information for limiting liquid discharge control by the discharge control circuit, and the discharge control information is rewritten when a signal according to the individual activation information is input from the outside.

* * * * *